US012692633B2

(12) United States Patent
Lee

(10) Patent No.: US 12,692,633 B2
(45) Date of Patent: Jul. 28, 2026

(54) BATHROBE WITH EXCELLENT HEAT RETENTION AND WASHING DURABILITY

(71) Applicant: BIZLINK CO., LTD, Daejeon (KR)

(72) Inventor: Jongseok Lee, Daejeon (KR)

(73) Assignee: BIZLINK CO., LTD, Daejeon (KR)

( * ) Notice: Subject to any disclaimer, the term of this patent is extended or adjusted under 35 U.S.C. 154(b) by 0 days.

(21) Appl. No.: 18/725,206

(22) PCT Filed: Dec. 28, 2022

(86) PCT No.: PCT/KR2022/021549
§ 371 (c)(1),
(2) Date: Jun. 28, 2024

(87) PCT Pub. No.: WO2023/128626
PCT Pub. Date: Jul. 6, 2023

(65) Prior Publication Data

US 2025/0064145 A1 Feb. 27, 2025

(30) Foreign Application Priority Data

Dec. 31, 2021 (KR) ..... 10-2021-0194102

(51) Int. Cl.
*D03D 15/292* (2021.01)
*D02G 3/38* (2006.01)
*D03D 15/217* (2021.01)
*D03D 15/283* (2021.01)

(52) U.S. Cl.
CPC ..... *D03D 15/292* (2021.01); *D02G 3/38* (2013.01); *D03D 15/217* (2021.01); *D03D 15/283* (2021.01)

(58) Field of Classification Search
None
See application file for complete search history.

(56) References Cited

U.S. PATENT DOCUMENTS 2,427,334 A * 9/1947 Alderfer ..... D03D 15/56 28/166
3,865,678 A * 2/1975 Okamoto ..... D03D 15/283 28/162
5,783,503 A * 7/1998 Gillespie ..... D04H 3/16 428/394
7,310,932 B2 * 12/2007 Liao ..... D03D 15/56 57/224
7,601,656 B2 * 10/2009 Horiguchi ..... D06N 3/0013 442/268
7,645,508 B2 * 1/2010 Uemura ..... D01F 8/14 428/370
7,696,110 B2 * 4/2010 Taniguchi ..... A47C 31/006 66/196
9,683,320 B2 * 6/2017 Lee ..... D02G 3/02
9,702,061 B2 * 7/2017 Anahara ..... D03D 27/00
2002/0127939 A1 * 9/2002 Hwo ..... D01F 8/14 428/374
2004/0175542 A1 * 9/2004 Miyasaka ..... D03D 15/283 442/364
2004/0224121 A1 * 11/2004 Sheppard, Jr. ..... D03D 15/217 428/92
2007/0087162 A1 * 4/2007 Mandawewala ..... D02G 3/36 428/95
2008/0085398 A1 * 4/2008 Yasui ..... D03D 15/292 428/152
2008/0132133 A1 * 6/2008 Yasui ..... D03D 15/283 442/200
2018/0347078 A1 * 12/2018 Goenka ..... D02G 3/406
2021/0381141 A1 * 12/2021 Ogata ..... D04B 1/20
2022/0178053 A1 * 6/2022 Wang ..... D03D 15/292
2022/0186439 A1 * 6/2022 Postl ..... D03D 1/0094

FOREIGN PATENT DOCUMENTS

CN 113718400 A * 11/2021
JP 2000144518 A * 5/2000
JP 3510731 B2 3/2004
JP 2007330427 A * 12/2007
KR 100409380 B1 12/2003
KR 20140102436 A * 8/2014 ..... D02G 3/36
KR 101561033 B1 10/2015
KR 20150128420 11/2015
KR 20180117367 10/2018
KR 101918944 B1 11/2018

OTHER PUBLICATIONS

Bahrami et al. "Thermal Behavior of Acrylonitrile Carboxylic Acid Copolymers." Journal of Applied Polymer Science, vol. 88, 685-698 (2003) https://onlinelibrary.wiley.com/doi/epdf/10.1002/app.11637 (Year: 2003).*

* cited by examiner

*Primary Examiner* — Grace Huang
(74) *Attorney, Agent, or Firm* — The Webb Law Firm

(57) ABSTRACT

Provided is a bathrobe which includes a terry fabric woven with a ground thread including a cotton yarn, a terry yarn formed of a core yarn including a nylon and polyester split type microfiber and a cover yarn covering the core yarn, and weft including a hollow yarn, and is light and has excellent heat retention.

9 Claims, No Drawings

BATHROBE WITH EXCELLENT HEAT RETENTION AND WASHING DURABILITY

CROSS-REFERENCE TO RELATED APPLICATIONS

This application is the United States national phase of International Patent Application No. PCT/KR2022/021549 filed Dec. 28, 2022, and claims priority to Korean Patent Application No. 10-2021-0194102 filed Dec. 31, 2021, the disclosures of which are hereby incorporated by reference in their entireties.

BACKGROUND

Technical Field

The present disclosure relates a bathrobe formed of a fabric having a terry structure using a hollow fiber.

Technical Considerations

Recently, in the textile industry, studies on a composite high-performance fiber having various functions are being actively performed. In particular, a technology development trend of yarn and fabric is oriented to differentiation and proceeds in the direction of further enhancing the functionality of clothing, and in order to improve quality of human life, development of functional materials including safety, health, and high-quality products is in progress. The development of the functional materials as such are taking place in various fields of the textile industry, and the field of daily necessities is no exception.

It is important for daily necessities in direct contact with the skin such as a towel or a bathrobe to be soft to the touch, have good absorbency, and keep a clean feeling. In addition, since they should be often washed for the purpose of use, they should have excellent durability to washing. For this reason, cotton fiber has been mainly used in towels or bathrobes. Cotton fiber has high hygroscopicity, but since it contains a large amount of a hydroxyl group (—OH) in the main chain of cellulose which is the main component, absorbed moisture is not rapidly removed and tactile sensation is reduced by repeated washing.

In addition, since a bathrobe should rapidly absorb a large amount of moisture present on the surface of the body, and raise the dropped temperature of the body and maintain the temperature, it is required to have sweat-absorbing and fast-drying properties, absorbency, exothermic properties, and the like. These properties are not satisfied only by cotton fiber.

A bathrobe made of cotton is soft to the touch and has good absorbency, but is made of heavy materials, and in particular, has relatively low instant absorbency of remaining moisture, that is, a relatively low ability to instantly initially absorb moisture due to a high moisture content, and thus, is not comfortable to wear. Existing art is described in Korean Patent Laid-Open Publication No. 10-2015-0128420 (Nov. 18, 2015).

SUMMARY

An object of the present disclosure is to provide a bathrobe which has excellent heat retention, is light, allows the absorbed moisture to be rapidly dried, has excellent sweat-absorbing and fast-drying properties, and may maintain a soft touch even with repeated washing.

In one general non-limiting embodiment, a bathrobe includes: a terry fabric woven with a ground thread including a cotton yarn, a terry yarn, and weft including a hollow yarn, wherein the terry yarn includes a core yarn including a microfiber, and a cover yarn covering the core yarn, and the cover yarn includes a blended yarn of a bamboo fiber and an acrylic fiber.

In an exemplary and non-limiting embodiment of the present disclosure, the bathrobe in which the hollow yarn may have an annular section or a modified section, and a circular hollow portion may be formed in the center of the section of the hollow yarn is provided.

In an exemplary and non-limiting embodiment of the present disclosure, the bathrobe in which the hollow yarn may be a two-component side-by-side hollow conjugated yarn, and the two components may be a polyethylene terephthalate polymer and a polytrimethylene terephthalate polymer, a polyethylene terephthalate polymer and a polyethylene polymer, a polyethylene terephthalate polymer and a polypropylene polymer, or a polyethylene terephthalate polymer and a polyphenylene sulfide polymer is provided.

In an exemplary and non-limiting embodiment of the present disclosure, the bathrobe in which the hollow yarn may include one or more components selected from the group consisting of a bamboo fiber, a polyethylene terephthalate fiber, a polytrimethylene terephthalate fiber, and a polyethylene fiber is provided.

In an exemplary and non-limiting embodiment of the present disclosure, the bathrobe in which the terry yarn may be obtained by twisting and winding the cover yarn at 200 to 500 twists per meter ("T/M") on the surface of the core yarn is provided.

In an exemplary and non-limiting embodiment of the present disclosure, the bathrobe in which the microfiber is formed of a total of 70 to 100 filament yarns to have a total fineness of 100 to 300 deniers is provided.

In an exemplary and non-limiting embodiment of the present disclosure, the bathrobe in which the terry yarn may be obtained by twisting the core yarn including the microfiber with the cover yarn including the blended yarn of the bamboo fiber and the acrylic fiber and then performing a heat treatment so that the cover yarn is fixed on the core yarn is provided.

In an exemplary and non-limiting embodiment of the present disclosure, the bathrobe in which the heat treatment may be performed by applying heat at 110 to 130° C. is provided.

In an exemplary and non-limiting embodiment of the present disclosure, the bathrobe in which the cover yarn may have a mixing weight ratio between the bamboo fiber and the acrylic fiber of 3:7 to 7:3 is provided.

In an exemplary and non-limiting embodiment of the present disclosure, the bathrobe in which the core yarn may be a nylon and polyester split type microfiber is provided.

In an exemplary and non-limiting embodiment of the present disclosure, the bathrobe in which the core yarn may have a weight ratio between nylon and polyester of 2:8 to 3:7 is provided.

In an exemplary and non-limiting embodiment of the present disclosure, the bathrobe in which the ground thread may include a cotton yarn having a cotton yarn number of 20 to 40 is provided.

The present disclosure provides a bathrobe which includes a terry fabric woven with a ground thread including a cotton yarn, a terry yarn formed of a core yarn including a nylon and polyester split type microfiber and a cover yarn covering the core yarn, and weft including a hollow yarn, and since the bathrobe includes a cotton yarn and a hollow yarn in a ground weave, a bathrobe which is light and has excellent heat retention may be provided.

DETAILED DESCRIPTION

The following specific examples or exemplary and non-limiting embodiments are only a reference for describing the present disclosure in detail, and the present disclosure is not limited thereto, and may be implemented in various forms.

In addition, unless otherwise defined, all technical terms and scientific terms have the same meanings as those commonly understood by one of those with ordinary skill in the art to which the present disclosure pertains. The terms used herein are only for effectively describing a certain specific example, and are not intended to limit the present disclosure.

In addition, the singular form used in the specification may be intended to also include a plural form, unless otherwise indicated in the context.

In addition, unless particularly described to the contrary, "comprising" any elements will be understood to imply further inclusion of other elements rather than the exclusion of any other elements.

The present disclosure may prevent the body temperature from being lowered after swimming or bathing.

Here, a "bath" includes all actions in which a human body part is brought into contact with water, such as a bath, a shower, or washing up, and a "gown" is defined as a gown worn before or after bathing in a broad sense as described.

The term "terry fabric" used in the present disclosure is generally referred to as a warp pile fabric, and is a fabric obtained by making a bottom (ground weave) with a kind of warp and weft and then arranging separate pile warp to form a pile or a tuft on the fabric surface. More specifically, it refers to a warp pile fabric having a multilayer structure in which a ring is formed with a special warp called a terry pile on a bottom.

In a manufacturing method of the terry fabric according to the present disclosure, first, a ground thread and a pile warp are wound on a separate beam, respectively, and a strong tension is applied to the ground thread and a weak tension is applied to the pile warp in a loom with a special weft hitting device. Here, the ground thread and the pile warp are alternately arranged. A first weft and a second weft are entered between warps and picked, and a third weft is entered between warps and then strongly picked so that the pile warp is pushed forward to weave the terry fabric in which a loop is formed on both surfaces of the bottom.

A cotton yarn, a hemp fiber, a wool fiber, or a regenerated fiber may be included in the ground thread of the bottom (ground weave), and it is most preferred to use a cotton yarn formed of a cotton fiber, since it is environmentally friendly and good to the skin.

It is preferred that the fineness of the ground thread has the cotton yarn number of 20 to 40, since weavability and mechanical strength are secured to be advantageous for manufacture, and the manufactured towel has a good tactile feel. In the weaving process, a tension is strongly applied to the ground thread, and thus, productivity may be deteriorated when the cotton yarn number is more than 40.

The hollow yarn may be used as the weft, and the section of the hollow yarn may be a circular section or a modified section, and a circular hollow portion may be formed in the center of the hollow yarn section.

The hollow yarn may have one or more components selected from the group consisting of a bamboo fiber, a polyethylene terephthalate fiber, a polytrimethylene terephthalate fiber, and a polyethylene fiber.

As the hollow yarn, a two-component side-by-side hollow conjugated yarn may be used, and the two components may be a polyethylene terephthalate polymer and a polytrimethylene terephthalate polymer, a polyethylene terephthalate polymer and a polyethylene polymer, a polyethylene terephthalate polymer and a polypropylene polymer, or a polyethylene terephthalate polymer and a polyphenylene sulfide polymer.

When the two-component hollow conjugated yarn is used, heat retention and resilience are good. When there is no hollow portion, the effect of heat retention, resilience, and lightness may not be expected.

A hollow ratio of the hollow yarn may be 5 to 30%, preferably 5 to 20% of a total area. When the hollow ratio is satisfied, the bottom (ground weave) may have a natural tactile feel, good absorption properties, and a hollow portion to increase a pneumatization rate. When the pneumatization rate is high, heat retention is excellent.

The bottom may have excellent sweat-absorbing and fast-drying properties and heat retention.

The polytrimethylene terephthalate (PTT) used in the present disclosure is a kind of polyester yarn, and is manufactured by changing the conventional synthesis structure to make the tactile feel the same as or better than nylon.

Polyethylene terephthalate (PET) which is the other component used in the present disclosure is generally used after being subjected to a melt spinning process in which PET which is a thermoplastic polymer is extruded by a spinneret at a temperature of a melting point or higher to be cooled and solidified, and then is wound.

The section of the hollow conjugated yarn arranged in a side-by-side type may be circular, and in the center, a circular hollow portion may be formed at an area ratio of 5 to 30% (porosity) of the total area. When the hollow yarn having the porosity is used, the rates of absorption, diffusion, and evaporation of moisture may be increased due to the capillary phenomenon of the hollow yarn.

The fineness of the monofilament of the hollow yarn may be 1.5 to 5 deniers. It is preferred to satisfy the fineness considering the elasticity of the hollow yarn. The fineness may be more preferably 2 to 5 deniers.

The modified section of the hollow yarn may have an oval, triangular, or three or more-leaf shape structure.

When the hollow yarn is formed of a modified cross-section fiber, the surface area is increased, thereby implementing a bathrobe which is soft to the touch, is light, and has heat retention to give a wearer a warm feeling.

The terry yarn of the present disclosure is formed of a core yarn and a cover yarn covering the core yarn.

As the core yarn, a nylon and polyester split type microfiber or a sea island type polyester microfiber may be used. With the microfiber included, initial absorption force is excellent so that comfortable wearing sensation and a moisture drying effect may be obtained and the fabric may be soft and comfortable to the touch.

The nylon and polyester split type microfiber is formed of a total of 70 to 100 filament yarns and has a total fineness of 100 to 300 deniers, and is microfiberated by a weight deduction process to have a fineness of 0.01 to 1 denier/filament. The nylon and polyester split type microfiber has micropores between fibers formed by the microfiberation process and an increased fiber surface area, thereby having a greatly increased moisture absorption capacity. Further, the microfiber may exert an effect of instantly adsorbing and moving moisture present in the skin by a capillary phenomenon.

In addition, when the fineness is satisfied, the microfiber has durability for repeated washing to prevent the core yarn from coming out to the surface of the bathrobe and clumping together by friction.

As the weight deduction process, a common weight deduction process is applied. An alkaline soluble weight deduction process may be applied. However, the present disclosure is not limited thereto. By minimizing alkali invasion, invasion of components other than a dissolving resin is prevented. The weight deduction process may be performed before or after covering. The alkali soluble weight deduction process may be performed at 100 to 130° C. for 30 minutes to 60 minutes.

In addition, the core yarn may have a weight ratio between nylon and polyester of 2:8 to 3:7.

On the other hand, a sea-island type polyester microfiber may be used as the core yarn.

On the other hand, a low-melting point polyester yarn may be included in the core yarn. The content may be less than 1 part by weight with respect to 100 parts by weight of the nylon and polyester split type microfiber. More preferably, the content may be 0.5 parts by weight or less. The low-melting point polyester yarn fixes the cover yarns to the core yarn by a heat treatment performed after the covering process and may prevent the core yarn of the terry yarn from coming out of the surface of the cover yarn by repeated washing of the bathrobe. In addition, the content may be only a content to fix the cover yarn to the core yarn.

The cover yarn may include a mixed yarn of a bamboo fiber and an acrylic fiber.

Since the bamboo fiber obtained by extracting cellulose from bamboo has better hygroscopicity and natural antibacterial action, the bathrobe including the bamboo fiber may have refreshing feel.

Since the section of the bamboo fiber has a modified section having a large surface area and has a thin and long hollow structure inside the fiber, the bamboo fiber has a nature of rapid absorption and dissipation, is soft to the touch, and has a deodorization function, Therefore, effects of having no irritation to the skin, instantly absorbing moisture from the skin, and rapidly moving the moisture out of the bathrobe may be shown by including the bamboo fiber in the cover yarn. Meanwhile, since the bamboo fiber is a hollow yarn of the modified section, wet heat released from the acrylic fiber is contained to improve heat retention.

The cover yarn may include the acrylic fiber. By using the acrylic fiber, high hygroscopic heat is released when the moisture is absorbed in the bathrobe, thereby preventing a wearer's body temperature from being lowered.

The acrylic fiber used in the present disclosure may be an acrylic fiber having a polar group, The acrylic fiber used in the present disclosure may include a carboxylic acid group, has a high moisture absorption rate since the hydrophilic group is arranged on the surface of fiber, and thus, may have a characteristic of high occurrence of hygroscopic heat.

When a water vapor molecule is bonded and fixed by the hydrophilic group (polar group) of the acrylic fiber included in the terry yarn of the bathrobe, the temperature energy of the water molecule is lowered to cause energy conversion to generate adsorption, and when the water vapor adsorbed on the fiber changes to a liquid, condensation heat is added and when the heat is released, the heat is transferred to the skin, and the liquid is transferred to the outside of the bathrobe by the bamboo fiber. The remaining heat is maintained by the bamboo fiber.

When the bamboo fiber and the acrylic fiber are mixed at the following weight ratio, the effect of the action may be optimized. The weight ratio may be preferably 4:6 to 7:3 or 4:6 to 6:6, more preferably 5:5 to 7:2, and most preferably 5:5 to 4:6.

When the mixing ratio between the bamboo fiber and the acrylic fiber satisfies 3:7 to 7:3, the wet heat occurring from the acrylic fiber and the quick drying and heat retention in the bamboo fiber may be balanced.

After the covering process, a heat treatment may be performed at 110 to 130° C. for 25 minutes to 50 minutes. By the heat treatment, the acrylic fiber and the bamboo fiber which are the cover yarn may be fixed to the core yarn and prevent deformation of the surface of the bathrobe, in which the microfiber which is the core yarn comes out by repeated washing or the cover yarn is broken to feel rough on the surface of the bathrobe. Since the bathrobe should be washed often for maintaining cleanliness, washing durability is required. That is, high tenacity to withstand friction occurring in a washing process is required, and a soft feel should be maintained even with repeated washing.

The terry fabric after weaving undergoes a first dyeing step for dyeing weft.

In the present disclosure, the first dyeing step is performed for dyeing the weft which is two-component modified section hollow yarn of a polyethylene terephthalate polymer and a polytrimethylene terephthalate copolymer, polyethylene terephthalate polymer and a polyethylene copolymer, a polyethylene terephthalate polymer and a polypropylene polymer, or a polyethylene terephthalate copolymer and a polyphenylene sulfide polymer and the core yarn of the terry yarn.

In the first dyeing step, it is appropriate to use a disperse dye, and since the disperse dye is insoluble or poorly soluble in water, a pretreatment step may precede easy dyeing. The pretreatment step may use a pretreatment solution in which chemicals including a scouring agent, a carrier, a dispersing agent, and a retardant are mixed in dyeing water.

The dyeing water is purified water and has a water hardness of 30 to 100 ppm, but is not limited thereto.

The scouring agent is for removing various impurities attached to the surface of fiber, and it is preferred to use a nonionic activator such as polyoxyalkylene ether, or a mixture of the nonionic activator with an anionic activator such as an alkylbenzene sulfonate, a sulfate ester salt of aliphatic alcohol.

The dispersing agent is a chemical for removing various impurities attached to the surface of fiber, and preferably, it is preferred to use water-based dispersing agents such as a sodium naphthalene sulfate-formalin condensate, sodium alkyl naphthalene sulfonate, or a formalin condensate thereof, a formalin condensate of sodium phenol sulfonate and sodium naphthol sulfonate, sodium alkyl diphenyl ether disulfonate, sodium ligninsulfonate, nonionic surfactant polyoxyethylene alkyl (allyl) ether, a mixed aid of a nonionic surfactant and a anionic surfactant, a sulfonated nonionic surfactant, sodium polyacrylate, an olefin-sodium maleate copolymer, a condensed phosphate, and carboxymethyl cellulose, and a non-water-based dispersing agent such as alkylbenzene (naphthalene) sulfonate, sodium dioctylsulfone maleate, a partial imidized or partial esterified product of a styrene-anhydrous maleic acid copolymer, a fatty acid amide, polyoxyethylene alkylamine, an acetate or a fatty acid salt alkylamine, alkyl sec-(tert-) amine or amide, and alkylimidazoline.

The carrier serves to increase water solubility of fiber by a swelling action to relax a fibrous structure forming the core yarn. In addition, when a general disperse dye is used, the temperature of the dye solution varies with the fiber, but usually dyeing is performed under the condition of 120° C. or higher, since a cavity is formed in the fiber so that the dye may penetrate at the temperature or higher. However, when a carrier is used as in the present disclosure, the dyeing process may be effectively performed with less energy used.

As the carrier which may be used in the present disclosure, trichlorobenzene, methyl naphthalene, ortho-phenylphenol, N, N-dimethylsulfoxide, and N-methyl-2-pyrrolidone may be preferably used.

The retardant is a chemical for suppressing rapid dyeing for preventing in the first dyeing step, and preferably, sodium sulfate, sodium chloride, sodium carbonate, and the like may be used.

In addition, the pretreatment solution may further include an acid, and the acid serves to enhance the color of the dyeing by further lowing the pH of the pretreatment solution. As the acid, an acid commonly used in the art may be used.

It is preferred that the pretreatment solution includes 1 to 2 wt % of the scouring agent, 0.1 to 1 wt % of the carrier, 0.1 to 1 wt % of the dispersing agent, 1 to 2 wt % of the retardant, and a balance of water, and it is more preferred that the pretreatment solution further includes 0.01 to 0.1 wt % of the acid.

In the pretreatment step, it is preferred that the terry fabric is immersed in a bath containing the pretreatment solution at 90 to 110° C., preferably 95 to 100° C. for 10 to 30 minutes, for shrinking the core yarn and facilitating penetration of the disperse dye.

The dyeing method in the first dyeing step may be any dyeing method known in the art, and the present disclosure is not limited thereto.

The disperse dye is a dye having one or a plurality of multiple chromophores, and an azo dye, an anthraquinone dye, a quinophthalone dye, a naphthalimide dye, a naphthoquinone dye, a nitro dye, and the like may be used, and the disperse dye may include, for example, I. Disperse Yellow 3, C. I. Disperse Yellow 5, C. I. Disperse Yellow 64, C. I. Disperse Yellow 160, C. I. Disperse Yellow 211, C. I. Disperse Yellow 241, C. I. Disperse Orange 29, C. I. Disperse Orange 44, C. I. Disperse Orange 56, C. I. Disperse Red 60, C. I. Disperse Red 72, C. I. Disperse Red 82, C. I. Disperse Red 388, C. I. Disperse Blue 79, C. I. Disperse Blue 165, C. I. Disperse Blue 366, C. I. Disperse Blue 148, C. I. Disperse Violet 28, and C. I. Disperse Green 9.

In addition, the disperse dye may be selected from an appropriate database (for example, "color index"). Details or other examples of the disperse dye are described in "Industrial Dyes" (Klaus Hunger, Wiley-VCH, Weinheim, 2003, pages 133-158). Thus, the disperse dyes may be selected with reference to the documents. In addition, the disperse dye may be used in combination of two or more.

In addition, in order to impart other functions, in addition to the disperse dye, an additive such as an antioxidant, a pH adjusting agent, a surface tension reducing agent, a thickener, a humectant, a concentrated dyeing agent, a preservative, a fungicide, an antistatic agent, a metal ion blocking agent, and a reduction inhibitor may be used in the first dye solution composition.

It is preferred that the first dye solution composition includes 1 to 3 wt % of the disperse dye, 1 to 5 wt % of the additive, and a balance of water.

It is preferred that the first dyeing step is performed at 90 to 110° C., preferably 95 to 100° C., and most preferably 96 to 98° C., since the core yarn in the pile warp shrinks, the carrier extends an irregular portion of filament forming the core yarn so that dyeing is performed better, and fastness is improved. In addition, it is preferred that the first dyeing step is performed for 1 to 2 hours for uniform dyeing.

When the first dyeing step is finished, the dye solution is removed from a bathtub, and a scouring and bleaching step is performed right away in the same bathtub. The scouring and bleaching step is a common process of fiber forming the bottom and fiber forming the pile warp, and foreign substances and unreacted colorants may be removed, and also an effect of improving absorbency may be shown, by the process.

The scouring agent used in the scouring and bleaching step may be an inorganic scouring agent or an organic scouring agent commonly used in the art, and for example, sodium hydroxide (NaOH), sodium carbonate ($Na_2CO_3$), sodium bicarbonate ($NaHCO_3$), sodium sesquicarbonate ($Na_2CO_3NHCO_32H_2O$), sodium silicate ($xNa_2Si_4O_9$+$yNa_2Si_2O_3$+$zH_2O$), lime (calcium oxide; CaO), calcium hydroxide ($Ca(OH)_2$), and the like may be used.

The bleaching agent used in the scouring and bleaching step decomposes a coloring material by an oxidation and reduction action, and for example, chlorine-based bleaches such as bleaching powder ($Ca(OCl)_2$), sodium hypochlorite (NaClO), and sodium chlorite ($NaClO_2$), peroxide-based bleaches such as hydrogen peroxide ($H_2O_2$), sodium peroxide ($Na_{202}$), sodium perborate ($NaBO_3 \cdot 4H_2O$), and potassium permanganate ($KMnO_4$), and sulfite-based bleaches such as sulfurous acid gas ($SO_2$), acidic sodium sulfite (NaHSO3), and sodium hyposulfite ($Na_2S_2O_4$) may be used.

In addition to that, a chelating agent such as aminopolycarboxylic acid (ethylenediaminetetraacetic acid; EDTA), hydroxypolycarboxylic acid (citric acid), amino-methylphosphonic acid (ethylenediaminetetra-methyl phosphonic acid; EDTMP), polycarboxylic acid (oxalic acid), and sodium polyphosphate (sodium hexametaphosphate), or a stabilizer such as polysilicate and polyacrylate may be further added to the treatment solution composition used in the scouring and bleaching step.

It is preferred to perform the scouring and bleaching step at 90 to 98° C., preferably 95 to 98° C., and most preferably 96 to 98° C. Outside the above range, foreign substances, unreacted dyes, and the like are not removed well, and the core yarn dyed in the first dyeing step may be discolored.

It is preferred that the treatment solution composition may include 1 to 5 wt % of the scouring agent, 1 to 5 wt % of the beach, 0.1 to 5 wt % of the additive, and a balance of water.

After completing the scouring and bleaching process, a second dyeing step is performed.

In the second dyeing step also, only the treatment solution is changed and the process may be performed in the same bathtub, as in the scouring and bleaching step. In particular, in the dyeing method of the terry fabric according to the present disclosure, the weft at the bottom other than the nylon/polyester ("N/P") conjugated yarn is dyed by the disperse dye in the first dyeing step, and then a scouring process using caustic soda, a dyeing process appropriate for a celluloid fiber, and multiple post-treatment processes are performed to release remnants of the disperse dye, thereby increasing the fastness of the N/P conjugated yarn.

The second dyeing step is dyeing the bottom and the cover yarn of the terry yarn in the terry fabric, and it is preferred to use a reactive dye, and since the reactive dye has excellent fastness, the second dyeing process may be continuously performed without a washing process after the scouring and bleaching process, and dyeing in various colors is allowed, the reactive dye is preferred. However, since many undyed dyes are included in the reactive dye and a wastewater inflow rate reaches 10 to 50% of the total dye, it is preferred to select the dye considering the fixing rate with the fiber forming the bottom.

The reactive dye may be applied by adjusting the temperature of a dye solution depending on the intensity of the reactivity, and the kind is not limited as long as the dye may be applied regardless of the dyeing method such as batch dyeing and continuous dyeing.

The reactive dye is formed of a colorant matrix and a reactive group, and since the adsorption rate is greatly changed depending on the molecular structure of the colorant matrix even with the same reactive group, it is preferred to use a reactive dye combined with a colorant matrix having excellent fastness to a specific reactive group.

As the reactive group, it is preferred to have a vinylsulfone-based or a triazine-based reactive group, since the reactive groups are inexpensive, are irrespective of the dyeing method, form a stable bond with fiber, and have excellent fastness and dyeing levelness.

As the reactive dye used in the present disclosure, for example, Lanasol CE, Yellow light, Orange light, Blue light, Navy light, Red light, Rose light, Lemon light, Sky light, Cibacron FN, Red FN-3G, Red FN-G, and Cibacron LS available from CIBA Specialty Chemicals; Blue P-NFB liquid 50, yellow P-N3R liquid 33, and Red P-4BN liquid 25 available from Nippon Kayaku Co., Ltd.; Sumifix HE type available from Sumitomo Chemical Co., Ltd.; Sirius plus, Realan, and Reanova CA available from DyStar; Remazol RU-N available from Hoechst Mitsubishi Kasei Co.; Procion CX available from Geneka Technologies; optizal-based dyes available from Clariant, and the like may be used. These dyes all have a high fixing rate of 80% or more and excellent wet fastness, and thus, are appropriate for the present disclosure. Of course, the reactive dyes may be used in combination of two or more.

In addition, a second dye solution composition including the reactive dye may further include a mordant and a scouring agent.

The mordant serves to promote color development and dye the fiber with the colorant, and aluminum mordants such as alum (aluminum potassium sulfate, $AlK(SO_4)_2 \cdot 12H_2O$), aluminum acetate, and aluminum chloride, copper mordants such as copper acetate and copper sulfate, and sodium mordants such as anhydrous sulfate of soda (sodium sulfate) are preferably used, but are not limited thereto, and any mordant which is commercially used by a person with ordinary skill in the art is used.

The scouring agent serves to remove impurities so that the dye is adsorbed to the fiber well, and it is preferred to use one selected from the group consisting of alkyl sulfate, alkyl phosphate, alkyl sulfonate, alkyl polyoxyethylene ether sulfonate, and alkyl polyoxyethylene ether phosphate or a mixture thereof, but the present disclosure is not limited thereto.

The second dye solution composition may include 1 to 3 wt % of the reactive dye, 1 to 5 wt % of the mordant, 1 to 5 wt % of the scouring agent, and a balance of water.

The second dyeing step may be performed by a method commonly used in the art, and though it depends on a reactivity degree, it is preferred to perform the step at 40 to 80° C. for 1 to 3 hours.

In addition, in the present disclosure, a soaping treatment step may be further performed, after performing the second dyeing step and removing the second dye solution composition from the bathtub. The soaping process is for removing an unfixed dye remaining after dyeing, and preferably, is performed at a temperature of 90 to 110° C. for 20 minutes to 1 hour.

A soaping solution composition used in the soaping process may be prepared by adding a soaping agent to usual water having the temperature, and as the soaping agent, it is preferred to use PROTEPON RSA, PROTEPON NRC, or the like available from Protex Korea, but the present disclosure is not limited thereto. In addition, it is preferred to add 1 to 5 g of the soaping agent with respect to 1 L of water, since reattachment of impurities is prevented to increase fastness while the sequestering power of metal ions is maintained.

When the soaping process is finished, the soaping solution composition is removed from the bathtub and a softening treatment is further included and performed in the same bathtub. The softening treatment is for imparting rebound elasticity, smoothness, bulkiness, and a soft feel of the manufactured towel, and the softening treatment may be performed by a method commonly performed in the art.

In addition, it is preferred that the softening treatment is performed with the softening solution composition at 20 to 60° C. for 10 to 60 minutes.

The softening solution composition may be formed by including a softening agent and water, and the softening agent may be anything commonly used in the art. As the softening agent, for example, CSE-920 available from CHEONG SAN CHEM TECH Co., Ltd. may be used, but the present disclosure is not limited thereto, and it is preferred to add it at 1 to 5% on the weight of fiber (owf).

After the softening treatment, the treatment solution, moisture, and the like remaining the terry fabric are removed, and the terry fabric is cut depending on the conditions of sale to manufacture the towel according to the present disclosure.

The towel according to the present disclosure is manufactured by the method described above, and may be formed of a bottom including a ground thread and weft and pile warp which passes between the weft to form pile. Here, as described in the manufacturing method, the ground thread and the weft have the cotton yarn number of 10 to 60, and the core yarn in the pile warp may have a fineness of 60 to 160 D/72F and the covering twisted yarn may have a fineness of the cotton yarn number of 10 to 30.

In addition, the towel according to the present disclosure may be manufactured by including further a process of attaching a herbal medicine extract to the surface of the bottom and the pile warp. Here, it is preferred that the attaching washing and drying processes are process is performed after finished after the softening treatment step.

As the herbal medicine extract, any one selected from fruit of *Schisandra chinensis*, a barberry root, *Houttuynia cordata, Anemarrhena, taraxacum* herb, a peony, weeping forsythia, and flower of Japanese honeysuckle or a mixture thereof may be used. The herbal medicine may impart a unique natural fragrance to the manufactured towel and minimize skin irritation. In addition, a stronger antibacterial effect with the antibacterial effect of the bamboo fiber may be caused.

A method of extracting the herbal medicine may be performed by a common method, for example, heating of using a solvent, and if necessary, by concentration.

It is preferred to use a binder for attaching the herbal medicine extract to the surface of fiber. The binder is hydrophilic and is not limited thereto as long as it does not greatly deteriorate the physical properties of the manufactured towel.

As the binder, preferably a polycarboxylic acid such as an aliphatic polycarboxylic acid, an alicyclic polycarboxylic acid, an aromatic polycarboxylic acid, a saturated aliphatic dicarboxylic acid, an unsaturated aliphatic dicarboxylic acid, an aromatic dicarboxylic acid, or an alicyclic dicarboxylic acid; and a glycol-based polymer as polyethylene glycol or such polypropylene glycol may be used.

As the method of attaching the herbal medicine extract, a common method used in the art, for example, a dipping method, a spraying method, a coating method, and the like may be used, and preferably a dipping method may be used.

The herbal extract and the binder may be attached in a liquid form including a solvent, and the contents may be preferably 1 to 10% of the herbal medicine extract and 5 to 20% of the binder, owf. In addition, the solvent may be a common solvent which may dissolve both the binder and the herbal medicine extract, but the present disclosure is not limited thereto.

Hereinafter, in the examples and the comparative examples, the physical properties were measured as follows.

1. Hygroscopic Heat Release Test (KS K 0589:2014 (Method A))

The terry fabrics for a bathrobe manufactured in the examples and the comparative examples were allowed to stand in low humidity conditions (34° C., RH 10%) for 3 hours, and then a maximum exothermic temperature on the surface of samples due to the moisture absorption when the fabrics were exposed to high humidity conditions (34° C., RH 90%) for 3 hours was measured. In addition, the hygroscopic heat release (absolute inventive) value was a value obtained by subtracting the temperature rise value of Comparative Example 1 from the temperature rise value of the example, and the temperature rise of only the wet exothermic fiber was calculated.

2. Heat Retention Test (Thermal Resistance, CLO; KS K 0466:2015)

It was developed in 1941 in order to explain how well clothing is protected from extreme temperatures with a CLO value which is a thermal insulation measurement of clothing.

A CLO value of 1 is the same as the amount of clothing required by a person at rest to remain thermally comfortable at room temperature of 21° C. or 71° F. The relative measure of CLO is shown in the following Table 1.

TABLE 1

| Clothing | CLO value |
|---|---|
| None (not worn) | 0 |
| Long trousers | 0.1 |
| Thick sweater | 0.35 |
| Down jacket | 0.55 |
| Parka | 0.7 |

Example 1

1) Manufacture of Wet Exothermic Fiber

An acrylonitrile-based polymer including 10 parts by weight of methyl ester acrylate with respect to 100 parts by weight of acrylonitrile was obtained. The polymer was dissolved in an aqueous calcium thiocyanate solution to prepare a spinning stock solution. The solution was spun to obtain an acryl fiber. A 15 wt % of the aqueous calcium thiocyanate solution was used as a coagulant at 25° C., and wet spinning was performed to obtain an acrylic fiber sample. The thus-obtained fiber was subjected to both a crosslinking introduction treatment and a hydrolysis treatment at 100° C. for 2 hours in an aqueous solution containing 0.5 wt % of hydrazine and 1.4 wt % of sodium hydroxide, treated with an 8 wt % aqueous nitric acid solution at 120° C. for 3 hours, and washed. The thus-obtained fiber was dipped in water, sodium hydroxide was added thereto to adjust the pH to 9, and an ion exchange treatment was performed by dipping in an aqueous solution in which an amount of magnesium nitrate equivalent to twice the amount of a carboxyl group included in the fiber is dissolved, and washing and drying were performed, thereby obtaining a Mg salt-type crosslinked polyacrylate fiber having a Mg salt-type carboxyl group.

The Mg salt-type crosslinked polyacrylate fiber and a bamboo fiber were blended to manufacture a wet exothermic fiber.

2) Manufacture of Terry Yarn

A yarn including 0.5 parts by weight of a low-melting point polyester yarn with respect to 100 parts by weight of a nylon and polyester split type microfiber (micronized fineness of 60D/72F) was used as a core yarn, and the wet exothermic fiber manufactured above was used as a cover yarn and was wound on (covered) the surface of the core yarn at 300 twists per meter ("T/M") in a Z-twist direction, thereby manufacturing a terry yarn.

3) Manufacture of Terry Fabric

A cotton yarn including a cotton fiber having a cotton yarn number of 30 was used as a ground thread, and a two-component modified section hollow yarn including polyethylene terephthalate polymer and a polytrimethylene terephthalate polymer was used as weft.

The cotton yarn and the terry yarn were alternately arranged and tension was strongly applied thereto, and the terry yarn was pulled with ½ the force of the tension applied to the cotton yarn to make the terry yarn loose. The arranged product is referred to as warp for convenience.

Two hollow yarns as the weft were entered between warps, light beating was performed, a third weft was entered, and strong beating was performed, so that three wefts were all entered into the bottom (ground weave), and the operation was repeated. As the operation was repeated, the tightly pulled ground thread did not sag, but the terry yarn was combined with three wefts and woven to form pile, thereby manufacturing a terry fabric.

The manufactured terry fabric was added to a bathtub containing a first dye solution composition including 1 wt % of a disperse dye (C.I. Disperse Red 60, LG Chem.), 1 wt % of a carrier (trichlorobenzene), and 98 wt % of water, and first dyeing was performed at 98° C. for 1 hour.

The terry fabric after the first dyeing released the first dye solution composition in the bathtub without washing, and a scouring and bleaching treatment solution was added thereto right away to perform a scouring and bleaching step at 98° C. for 30 minutes.

After the scouring and bleaching step, the treatment solution was released in the same bathtub, a second dye solution composition was added to the bathtub, and a second dyeing step was performed. At this time, the temperature of the dye solution composition was 60° C. and a treatment time was 1 hour. The second dye solution composition included 1 wt % of a reactive dye (Lanasol CE, CIBA Specialty Chemicals) and 99 wt % of water.

After the dyeing process, the second dye solution composition was removed from the same bathtub, a soaping solution to which 1 wt % of a soaping agent (PROTEPON RSA, Protex Korea) was added was added, and soaping was performed at 98° C. for 30 minutes.

After the soaping process, the soaping solution was removed from the same bathtub, a softening solution to which 1% (owf) of a softening agent (cse-920, CHEONG SAN CHEM TECH CO., Ltd.) was added was added, and softening was performed at 40° C. for 30 minutes.

After the soaping process, washing and drying were sufficiently performed to manufacture a specimen.

The terry fabric for a bathrobe manufactured was evaluated and is shown in the following Table 2.

Example 2

The process was performed in the same manner as in Example 1, except that the bamboo fiber and the Mg salt-type crosslinked polyacrylate fiber were blended at a weight ratio of 4:6 to manufacture a cover yarn.

Example 3

The process was performed in the same manner as in Example 1, except that the bamboo fiber and the Mg salt-type crosslinked polyacrylate fiber were blended at a weight ratio of 3:7 to manufacture a cover yarn.

Comparative Example 1

The process was performed in the same manner as in Example 1, except that the bamboo fiber and the Mg salt-type crosslinked polyacrylate fiber were blended at a weight ratio of 8:2 to manufacture a cover yarn.

Comparative Example 2

The process was performed in the same manner as in Example 1, except that the cover yarn was manufactured with 100% bamboo fiber.

Comparative Example 3

The process was performed in the same manner as in Example 1, except that the cover yarn was manufactured with 100% Mg salt-type crosslinked polyacrylate fiber.

Comparative Example 4

The process was performed in the same manner as in Example 1, except that 10 parts by weight of the Mg-type crosslinked polyacrylate fiber was blended with respect to 100 parts by weight of the polyester fiber to manufacture a wet exothermic fiber, and the wet exothermic fiber was used as a core yarn and 100% bamboo fiber was used as a cover yarn to manufacture a terry yarn.

Comparative Example 5

The process was performed in the same manner as in Example 1, except that a cotton yarn including a cotton yarn having a cotton yarn number of 40, not the hollow yarn, was used as the weft of the bottom (ground weave).

TABLE 2

| | Initial temperature (° C.) | Maximum rise temperature (° C.) | Temperature rise (° C.) | Hygroscopic heat release properties (° C.) |
|---|---|---|---|---|
| Example 1 | 33.8 | 41.1 | 7.3 | 5.3 |
| Example 2 | 33.9 | 42.1 | 8.2 | 7.2 |
| Example 3 | 33.8 | 41.9 | 8.1 | 7.1 |
| Comparative Example 1 | 33.9 | 39.2 | 5.3 | 5.0 |
| Comparative Example 2 | 33.8 | 38.7 | 4.9 | 4.6 |
| Comparative Example 3 | 33.8 | 42.7 | 8.9 | 8.6 |
| Comparative Example 4 | 33.8 | 38.2 | 4.4 | 4.1 |
| Comparative Example 5 | 33.9 | 39.2 | 5.3 | 5.0 |

In Table 2, the results of the hygroscopic heat test are shown, and as in Table 2, when an acrylic fiber is included, a hygroscopic heating phenomenon occurred, and as the content of the acrylic fiber was increased, the hygroscopic heating temperature was somewhat increased. It was recognized that when a hollow yarn was included in the terry fabric as in Example 1 and Comparative Example 5, a temperature rise was a little higher. Thus, it was found that the hygroscopic heat occurring from an acrylic fiber may be maintained between the bathrobe and the skin by the hollow yarn. Comparative Example 3 formed of 100% acrylic fiber had a highest hygroscopic heating temperature, but the quick drying properties of the bathrobe were decreased, and thus, it may feel uncomfortable.

TABLE 3

| | Example 1 | Example 2 | Example 3 |
|---|---|---|---|
| Thermal resistance, CLO | 0.78 | 0.57 | 0.81 |

Table 3 shows the results of heat retention test, and as described above, the CLO value 1 is the same as the amount of clothing required by a person at rest to remain thermally comfortable at room temperature of 21° C. or 71° F. Considering that the CLO value of a down jacket was 0.55 and the CLO value of a parka was 0.7, the CLO value of the terry fabric for a bathrobe manufactured from Examples 1 to 3 of the present disclosure of 0.57 or more means that the heat retention effect is large.

The invention claimed is:

1. A bathrobe comprising: a terry fabric woven with a ground thread including a cotton yarn, a terry yarn, and weft comprising a hollow yarn, wherein the terry yarn comprises a core yarn comprising a microfiber, and a cover yarn covering the core yarn, and wherein the core yarn comprises a nylon and polyester split type microfiber or a sea island type polyester microfiber, wherein the cover yarn comprises a blended yarn of a bamboo fiber and an acrylic fiber, having a polar group, wherein the cover yarn comprises a mixing weight ratio between the bamboo fiber and the acrylic fiber of 3:7 to 7:3, wherein the hollow yarn is a two-component side-by-side hollow conjugated yarn, and the two components are a polyethylene terephthalate polymer and a polytrimethylene terephthalate polymer, a polyethylene terephthalate polymer and a polyethylene polymer, a polyethylene terephthalate polymer and a polypropylene polymer, or a polyethylene terephthalate polymer and a polyphenylene sulfide polymer.

2. The bathrobe of claim 1, wherein the hollow yarn comprises a circular section or a modified section, and a circular hollow portion is formed in a center of the section of the hollow yarn.

3. The bathrobe of claim 1, wherein the hollow yarn comprises one or more components selected from the group consisting of a bamboo fiber, a polyethylene terephthalate fiber, a polytrimethylene terephthalate fiber, and a polyethylene fiber.

4. The bathrobe of claim 1, wherein the terry yarn is obtained by twisting and winding the cover yarn at T/M (number of twists per meter) 200 to 500 on a surface of the core yarn.

5. The bathrobe of claim 1, wherein the microfiber is formed of a total of 70 to 100 filament yarns and comprises a total fineness of 100 to 300 deniers.

6. The bathrobe of claim 1, wherein the terry yarn is obtained by twisting the core yarn comprising the microfiber with the cover yarn comprising the blended yarn of the bamboo fiber and the acrylic fiber and then performing a heat treatment so that the cover yarn is fixed on the core yarn.

7. The bathrobe of claim 6, wherein the heat treatment is performed by applying heat at 110 to 130° C.

8. The bathrobe of claim 1, wherein the core yarn comprises a weight ratio between nylon and polyester of 2:8 to 3:7.

9. The bathrobe of claim 1, wherein the ground thread comprises the cotton yarn having a cotton yarn number of 20 to 40.

* * * * *